US010451369B1

(12) United States Patent
Hunt et al.

(10) Patent No.: US 10,451,369 B1
(45) Date of Patent: Oct. 22, 2019

(54) SMOOTH OPERATING, LOW EFFORT AMBIDEXTROUS CHARGING HANDLE

(71) Applicants: Fred H. Hunt, Athol, ID (US); Tyler J. Tiller, Springfield, OR (US)

(72) Inventors: Fred H. Hunt, Athol, ID (US); Tyler J. Tiller, Springfield, OR (US)

(73) Assignee: Timber Creek Outdoors, Inc., Springfield, OR (US)

( * ) Notice: Subject to any disclaimer, the term of this patent is extended or adjusted under 35 U.S.C. 154(b) by 0 days.

(21) Appl. No.: 16/112,692

(22) Filed: Aug. 25, 2018

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06; F41A 7/02
USPC ..... 89/1.4, 1.42
See application file for complete search history.

(56) References Cited

U.S. PATENT DOCUMENTS 7,240,600 B1 * 7/2007 Bordson ..... F41A 3/72 42/69.01
7,798,045 B1 * 9/2010 Fitzpatrick ..... F41A 21/481 42/69.02
7,832,322 B1 * 11/2010 Hoel ..... F41A 35/06 42/16
9,222,738 B2 * 12/2015 Asher ..... F41A 35/06
9,726,445 B2 * 8/2017 Gomez ..... F41A 3/72
9,746,263 B2 8/2017 Hillman
9,964,371 B1 * 5/2018 Huang ..... F41A 3/72
10,006,728 B2 * 6/2018 Bailey ..... F41A 3/72
10,161,697 B1 * 12/2018 Underwood ..... F41A 3/72
2011/0174139 A1 * 7/2011 Olsen ..... F41A 3/72 89/1.4
2011/0226120 A1 9/2011 Fitzpatrick
2012/0291612 A1 * 11/2012 Kincel ..... F41A 3/72 89/1.4
2014/0060293 A1 * 3/2014 Gomez ..... F41A 3/72 89/1.4
2014/0345444 A1 11/2014 Hillman
2015/0233657 A1 * 8/2015 Barker ..... F41A 3/72 89/1.4
2016/0298917 A1 * 10/2016 Hwang ..... F41A 35/06
2016/0320151 A1 * 11/2016 Kincel ..... F41A 3/72
2016/0356564 A1 * 12/2016 Curry ..... F41A 3/72
2017/0023321 A1 * 1/2017 Kincel ..... F41A 3/72
2018/0149438 A1 * 5/2018 Headrick ..... F41A 9/59
2018/0266779 A1 * 9/2018 Reynolds ..... F41A 3/72

* cited by examiner

*Primary Examiner* — John Cooper
(74) *Attorney, Agent, or Firm* — Mersenne Law

(57) ABSTRACT

An ambidextrous charging handle for a semi-automatic rifle comprises left and right handles, a mechanism for securing the charging handle to the rifle when not in use, and at least one roller bearing positioned to facilitate smooth operation of the securing mechanism. Friction-reducing features may be provided to improve the sliding operation of the charging handle. Construction using aluminum or titanium permits the use of anodizing to improve surface toughness.

10 Claims, 6 Drawing Sheets

360
330
550
530
140
130
150

360
530
140
350
130
150

SMOOTH OPERATING, LOW EFFORT AMBIDEXTROUS CHARGING HANDLE

CONTINUITY AND CLAIM OF PRIORITY

This is an original U.S. patent application.

FIELD

The invention relates to firearm accessories. More specifically, the invention relates to an improved charging handle for a standard-configuration semi-automatic firearm.

BACKGROUND

A wide variety of firearms are known in the art. Some are highly focused to achieve a particular characteristic at the expense of others (e.g., target rifles are extremely accurate, but fairly easy to damage or knock out of alignment). Others are designed to perform well in a broader range of situations, while not excelling at any particular task. Some configurations are widely implemented, albeit with varying sizes and assembly details, so that a user of one such firearm can disassemble, reassemble and use a different firearm of the same design, even though the individual pieces of the two firearms may not be interchangeable. The popular 1911-style semiautomatic pistol is one such design. Finally, some designs are produced to comprehensive specifications such that the individual components are compatible and can be mixed-and-matched between different firearms, different manufacturers, and even different eras. The Armalite "AR-15" is an example of this last type.

Owners of common/compatible firearms often change or upgrade certain components to adapt the guns to the owner's particular application. For example, an AR-15 may be fitted with a longer barrel and high-magnification scope for use in target competitions. Some common customizations improve a firearm's utility for left-handed users.

AR-15 semi-automatic rifles (as well as some similar platforms such as M-4 and M-6 rifles) use a charging handle (also called a "cocking handle" or "bolt handle") to manually operate the action, for loading the first round from a new magazine (subsequent rounds are automatically loaded when the action cycles after a previous round is fired). They can also open the action for unloading (and for confirming that the firearm is unloaded), or to clear a jam or misfire. Thus, charging handles are a critical component of a firearm, notwithstanding that they are usually employed much less often than once per round fired. Improvements to the charging handle can help a gun operate more smoothly and reliably, and can make it easier for the user to shoot. FIG. 8 shows a left-side view of a typical AR-15 rifle, with the approximate location of the charging handle indicated by a dashed rectangle, and the direction of operation of the handle indicated by a heavy arrow.

SUMMARY

Embodiments of the invention are charging handles for AR-15 and similar semi-automatic rifles which are operable with either hand (i.e., ambidextrous) and which include ball- or roller-bearings to reduce operating effort and extend reliable operating term between cleanings. Other features and benefits of the invention are discussed below.

DETAILED DESCRIPTION

Figure 1:
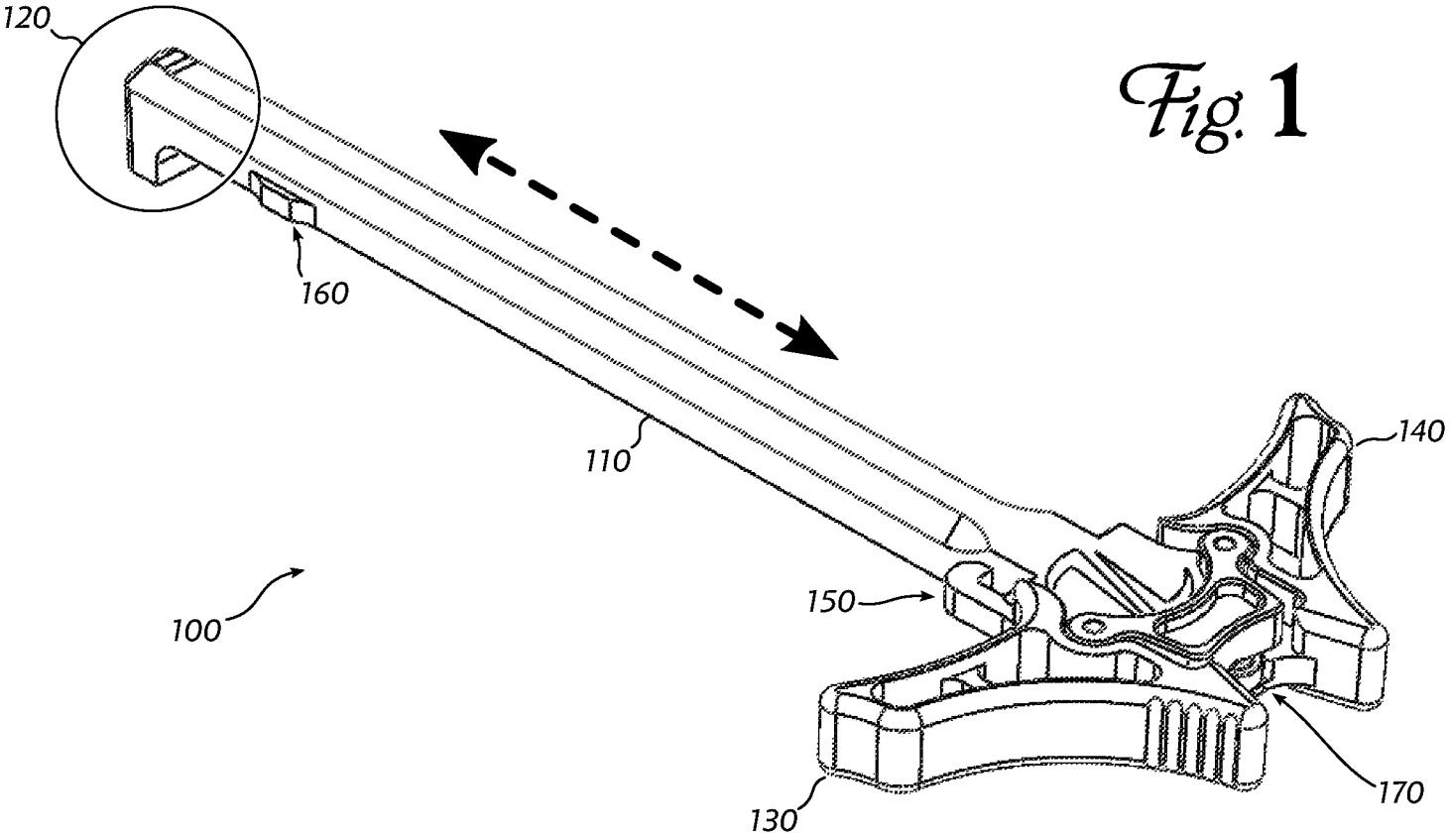
FIG. 1 is a perspective view of a preferred embodiment.
Figures 2A, 2B, 2C, 2D, 2E:
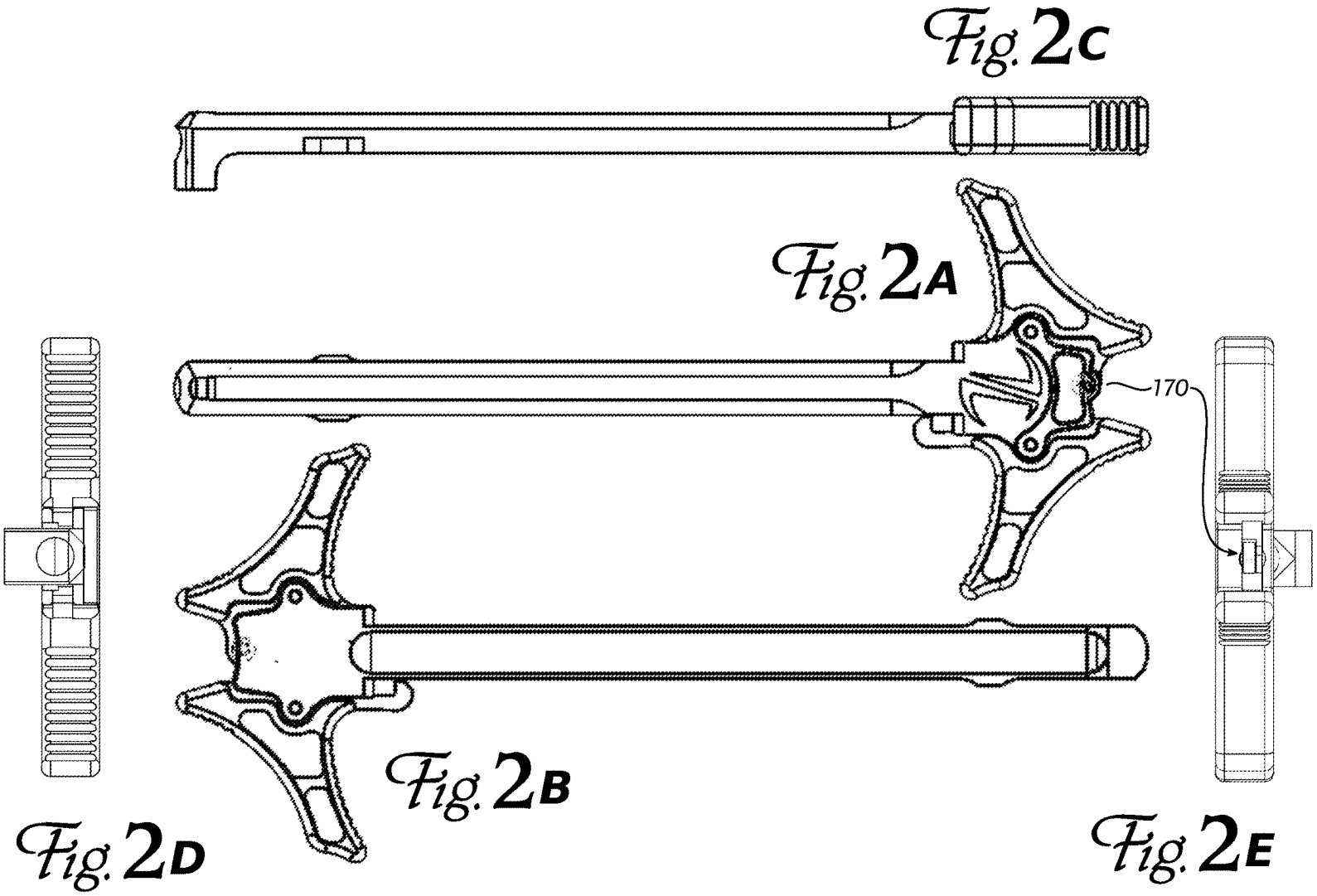
FIGS. 2A-2E are orthogonal views of the preferred embodiment.

FIG. 1 shows an embodiment of the invention (100). Generally speaking, an embodiment comprises an extended rod 110 which is shaped and sized to travel along a lengthwise axis in a complementarily-shaped channel of an upper receiver of a compatible firearm. One end of the extended rod (120) engages with the firearm's bolt mechanism so that the embodiment can perform its functions. When installed, this is the "front" or "forward" end of the extended rod—nearest the barrel of the firearm and furthest from the operator.

At the other end of the extended rod 110 (the "rear" end), left and right handles (130 & 140, respectively) may be grasped to pull the charging handle backwards and cycle the firearm's action. A latch 150 coupled with the left handle 130 secures the embodiment in the forward-most, idle position by engaging with a keeper or strike in the upper receiver. On left and right sides of the extended rod 110, assembly lugs 600 protrude slightly; these prevent the extended rod from falling out of the channel in the upper receiver. An embodiment comprises a ball or roller bearing, just visible in this view at 170, which improves the functioning of the device as detailed below.

FIGS. 2A-2E show top, bottom, left-side, front and rear views of the embodiment, respectively. They are provided for reference purposes, but specific features of an embodiment are more easily seen in other views, so only ball/roller bearing 170 is identified here. An embodiment may be made accurately and economically by computer-numeric controlled ("CNC") milling from bulk metal blanks of aluminum or titanium. These metals naturally develop a tough surface oxide coating, but their durability and appearance can be enhanced by anodizing the components before or after assembly. Many anodizing processes permit the surface color of the material to be specified, so a preferred embodiment may have one or more colored components, which a user may select to complement or contrast with other accessories on her firearm. One striking surface appearance can be obtained by milling the basic structures, anodizing them, and then milling further surface features such as text, graphics, or grip-enhancing ridges or knurls. The second-pass mill features expose the underlying material color (often gray or silver), which contrasts with the anodized color. The newly-exposed surfaces also develop a tough oxide coating, but this is generally transparent, so the milled designs stand out in the underlying material color.

Figure 3:
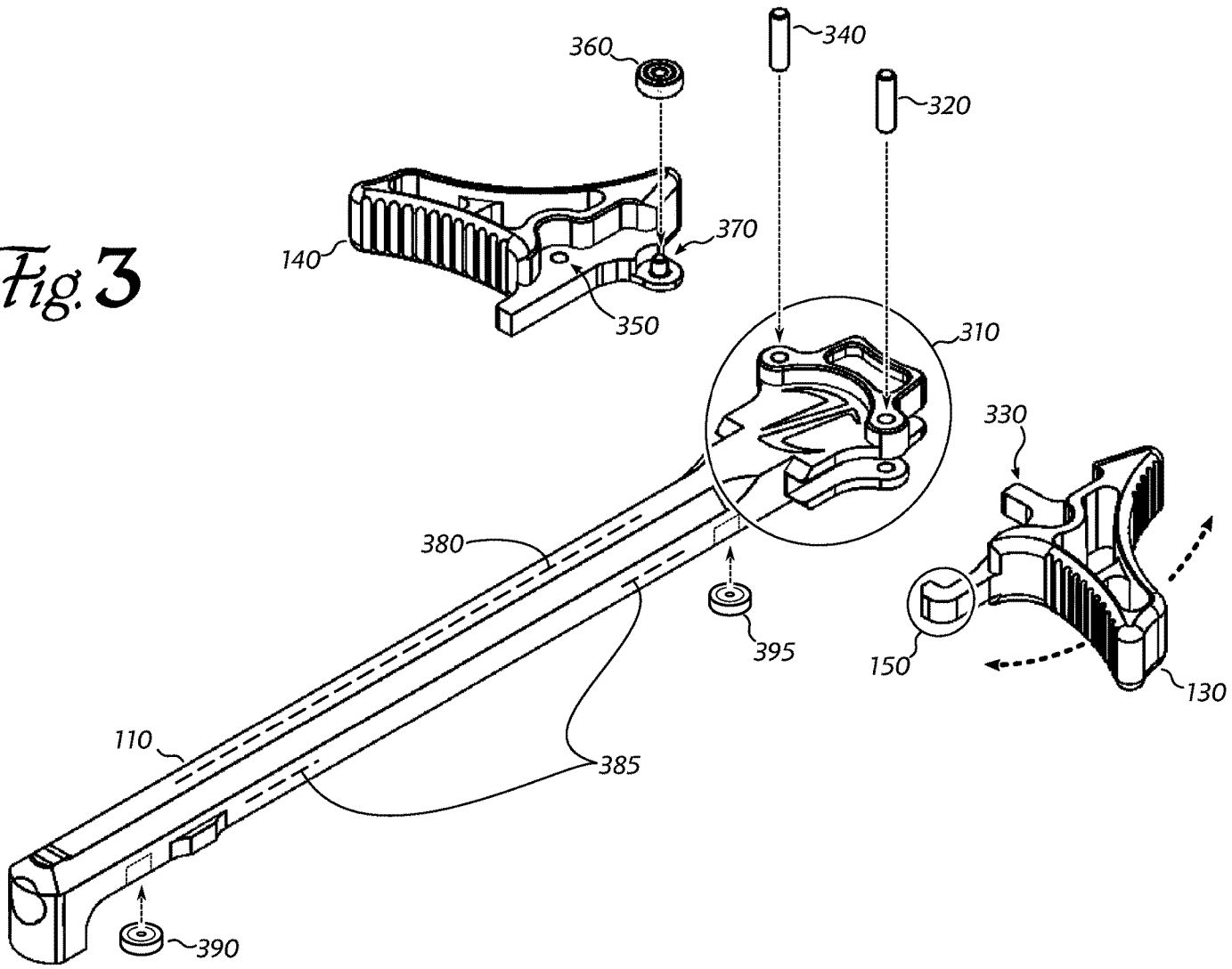
FIG. 3 is an exploded view of an embodiment.

FIG. 3 shows an exploded view of an embodiment, with a focus on the rear portion 310 of extended rod 110. The left and right handles (130, 140) are each secured to the corresponding left-rear and right-rear portions of the extended rod by vertically-oriented pivot pins 320 and 340. When assembled, left handle 130 can rotate about pivot pin 320 as shown by the curved, dashed arrows, and when so rotating, latch 150 moves in and out of engagement with the keeper in the upper receiver. This figure also shows a spur 330 which is part of left handle 130 and moves therewith.

Right handle 140, when assembled to the right rear portion of extended rod 110 by right pivot pin 340, can rotate about that pivot pin similarly to left handle 130 (but in a mirrored motion). Right handle 140 comprises a cylindrical bearing 360 which is assembled upon a bearing boss 370, in a similar (but not exact mirror-image) position to spur 330 of left handle 130. Bearing boss 370 is preferably parallel to pivot pins 320 and 340.

An embodiment may comprise features to reduce charging effort and improve operational smoothness. By placing a low-friction rib (380) along the top of the extended rod, a plurality of discontinuous low-friction ribs (385) along the side, or even cylindrical (roller) bearings (390, 395) to function similarly to wheels along the side of the extended rod, the rod's back-and-forth motion can be improved. Low-friction ribs may be, for example, a tough polymer bead such as nylon or polytetrafluoroethylene (trade name Teflon®) embedded in a channel milled into the extended rod.

Figure 4:
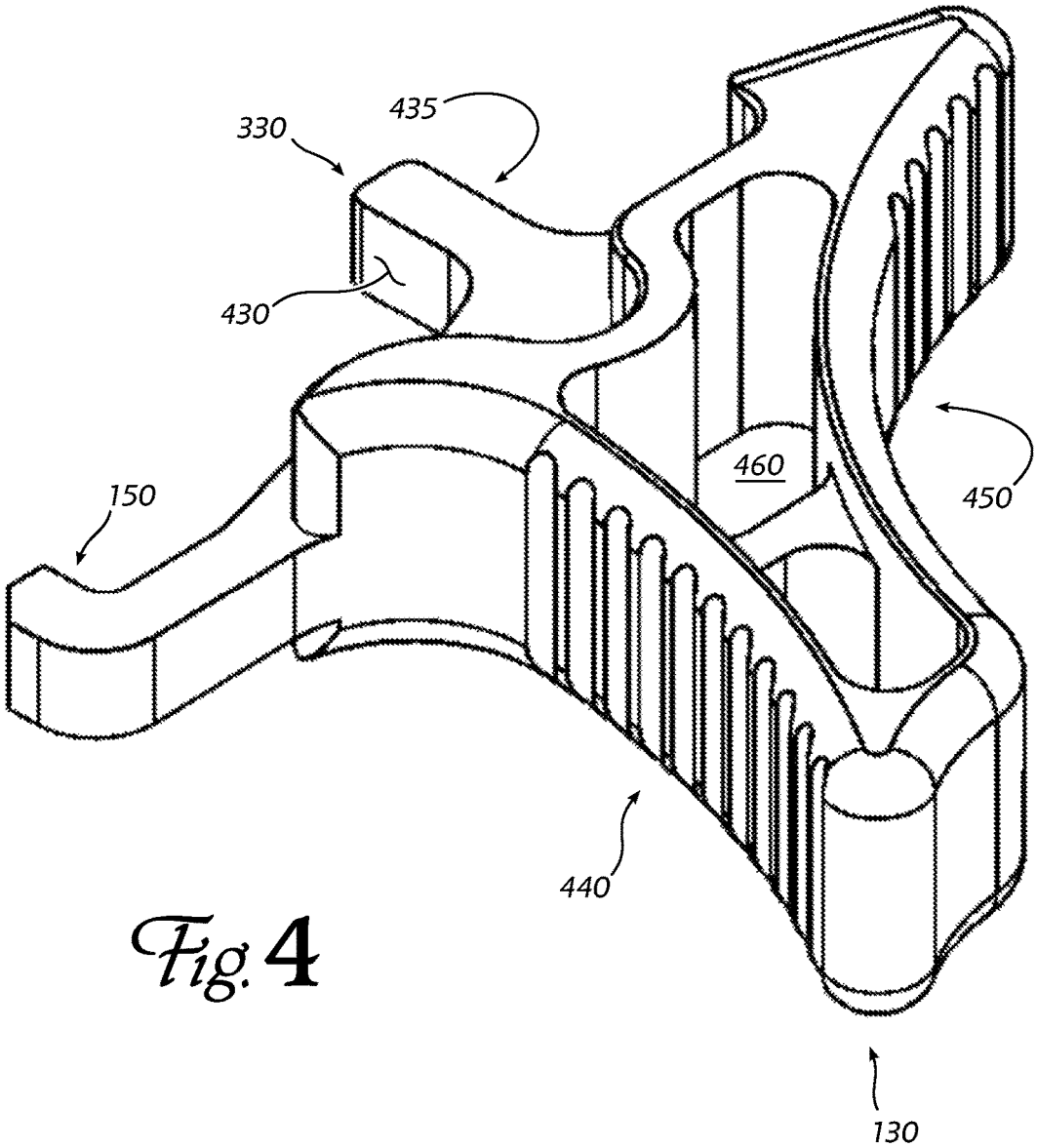
FIG. 4 is a detail of one component of an embodiment.

FIG. 4 shows a detailed view of left handle 130. Latch 150 and spur 330 are identified, and a forward-facing surface of spur 330 is marked as 430. Opposite forward-facing surface 430 is a substantially parallel rearward-facing surface at 435, but this surface is not visible in this view. Right handle 130 (as well as left handle 140) may have grip-enhancing features such as ridges 440 and 450, and the handle(s) may be skeletonized (460) (i.e., material may be removed from within the handle to reduce weight and/or to achieve a particular visual appearance.

Figure 5:
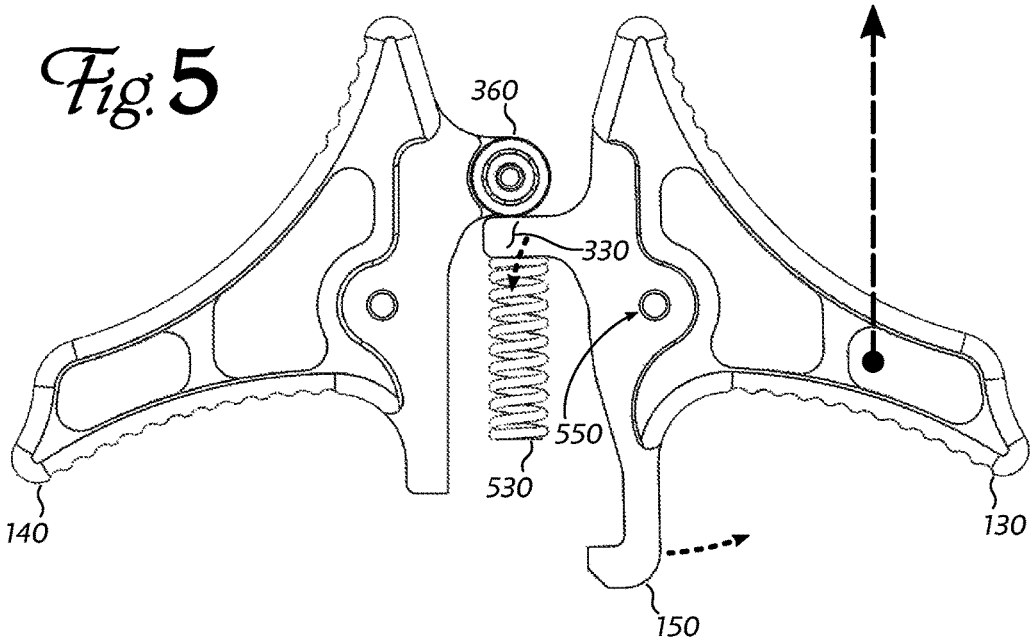
FIG. 5 illustrates how some components of an embodiment interact during one operation.

FIG. 5 is a plan view showing the left and right handles 130, 140 as they would be assembled at the rear portion of the extended rod, but the rod itself is omitted from this drawing. When left handle 130 is pulled rearward by the user (heavy dashed arrow), the handle rotates about the pivot pin through opening 550. As mentioned above, this motion causes latch 50 to rotate away from the outer surface of the upper receiver and to disengage from the keeper or strike thereupon, which permits the charging handle to be pulled backwards to cycle the firearm's action. As handle 130 rotates backwards (counterclockwise in this Figure), spur 330 rotates forward and compresses cylindrical coil spring 530, which is contained in a pocket formed in the rear portion of the extended rod. A central axis of coil spring 530 is aligned with the direction of travel of the extended rod of the charging handle. When left handle 130 is released, the firearm's action pulls the charging handle back to its forward position, and spring 530 urges the left handle 130 back to its un-rotated position so that latch 150 re-engages with the keeper on the outer surface of the upper receiver. When the charging handle is operated via left handle 130, right handle 140 is not significantly involved, although it may either be free to move, or may be held in a neutral position by another spring or similar component (not shown).

Figure 6:
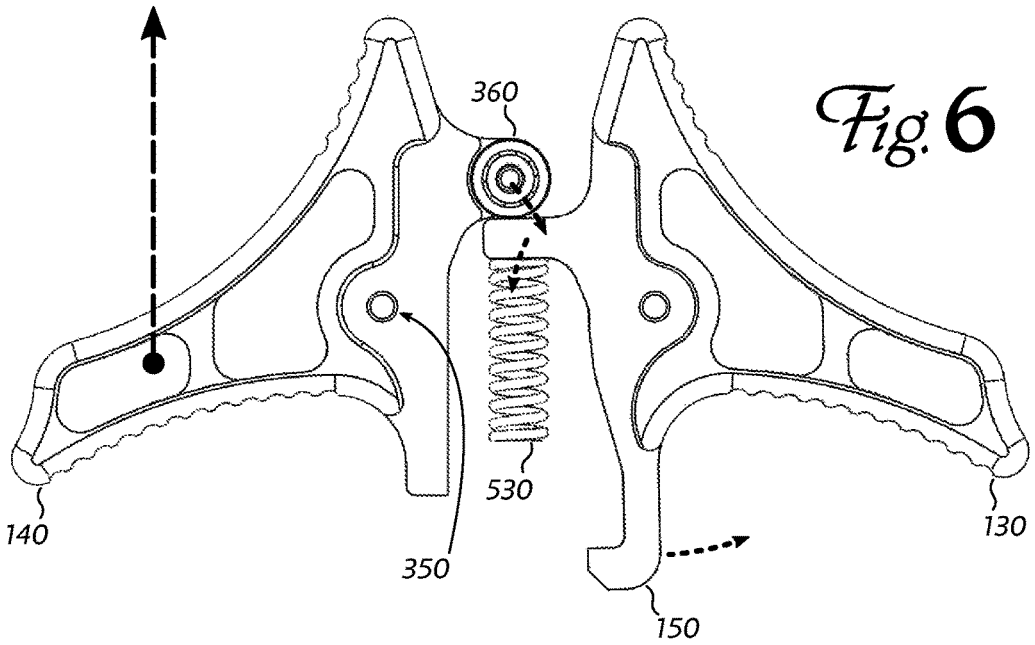
FIG. 6 illustrates how the components of an embodiment interact during another operation.

FIG. 6 shows how the charging handle can be operated via the right handle 140. In this ambidextrous mode, right handle 140 rotates about a pivot pin through opening 350. This motion causes cylindrical bearing 360 (on its boss) to rotate forward, pressing against the rearward-facing surface of spur 330. This urges the spur forward, as if handle 130 had been pulled back. When spur 330 moves forward, it compresses coil spring 530 and disengages latch 150 from the corresponding keeper in the upper receiver, permitting the charging handle to be drawn back to cycle the action. When the right handle 140 is released, the firearm's action pulls the charging handle forward, and latch 500 re-engages with the keeper.

Figure 7:
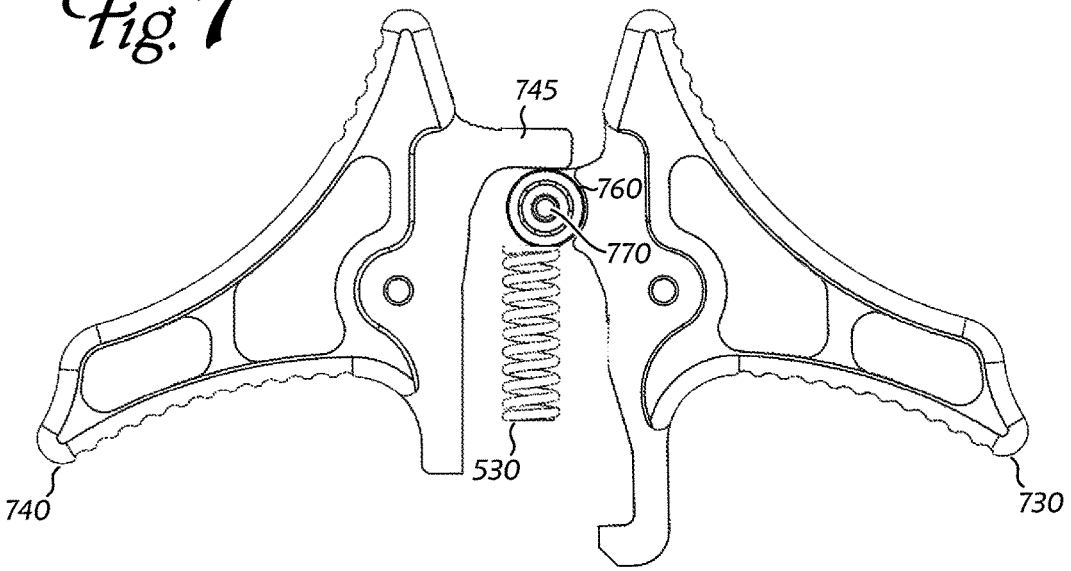
FIG. 7 shows another arrangement of components of an embodiment.
Figure 8:
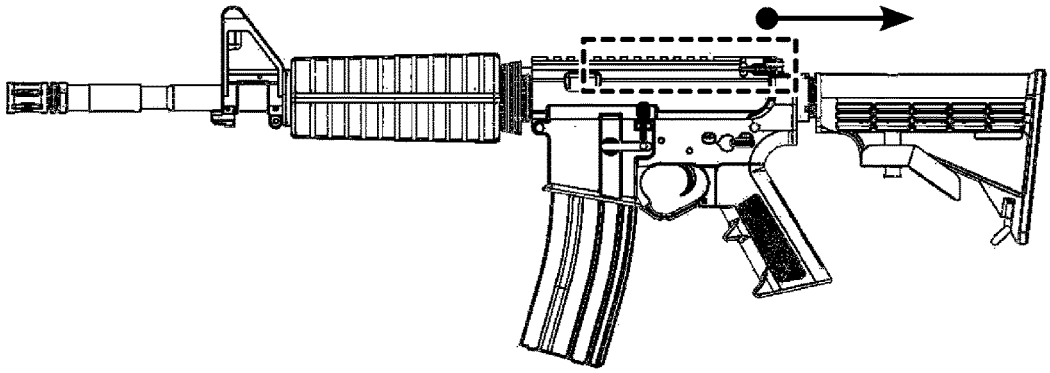
Fig. 8 (Prior Art)
FIG. 8 shows a prior-art firearm where an embodiment can be installed.

It is appreciated that cylindrical bearing 360 facilitates smoother and lower-effort actuation of the charging handle latch from the right handle 140, compared to (for example) a solid right-side spur that presses directly on left-side spur 330. An embodiment could reverse the positions of the spur and bearing, as shown in FIG. 7: there, bearing 760 rests on boss 770 and pushes against cylindrical spring 530 when left handle 730 is pulled back, while spur 745 on right handle 740 presses against bearing 760 when right handle 740 is pulled back. However, the preferred configuration places bearing 360 at the back of the charging handle, where it is clearly visible to the user and can be easily inspected for cleanliness and proper operation.

The applications of the present invention have been described largely by reference to specific examples and in terms of particular configurations of mechanical elements. However, those of skill in the art will recognize that a smooth-operating, ambidextrous charging handle can be constructed by arranging comparable elements differently than herein described. Such variations and implementations are understood to be captured according to the following claims.

We claim:

1. An ambidextrous charging handle for a semi-automatic rifle, comprising:

an extended rod shaped to travel along a lengthwise axis of the extended rod within a complementarily-shaped channel in an upper receiver of a semi-automatic rifle;

a moveable latch near a left rear portion of the extended rod, said moveable latch operative to secure the ambidextrous charging handle to the upper receiver;

a left handle coupled to the moveable latch and secured near the left rear portion of the extended rod by a vertically-oriented first pivot pin so that pulling rearward on the left handle causes the left handle to rotate about the first pivot pin and to disengage the moveable latch from the upper receiver;

a coil spring positioned near a central rear portion of the extended rod, an axis of the coil spring substantially aligned with the lengthwise axis of the extended rod;

a spur having a forward-facing face and a rearward-facing face, coupled to the left handle and contacting the coil spring so that pulling rearward on the left handle causes the coil spring to be compressed by the forward-facing face of the spur;

a right handle secured near a right rear portion of the extended rod by a vertically-oriented second pivot pin adjacent the first pivot pin so that pulling rearward on the right handle causes the right handle to rotate about the second pivot pin;

a cylindrical bearing having a vertical central axis parallel to the second pivot pin, said cylindrical bearing coupled to the right handle and positioned so that an outer surface of the cylindrical bearing is adjacent the rearward-facing face of the spur, wherein pulling rearward on the right handle urges the cylindrical bearing against the rearward facing face of the spur, causing the spur to compress the coil spring and disengage the moveable latch from the upper receiver.

2. The ambidextrous charging handle of claim 1, further comprising:

a plurality of bearings disposed on lateral surfaces of the extended rod, said plurality of bearings oriented to facilitate travel of the extended rod along the complementarily-shaped channel of the upper receiver.

3. The ambidextrous charging handle of claim 1, further comprising:

a low-friction rib secured to a surface of the extended rod adjacent an inner surface of the complementarily-shaped channel, said low-friction rib operative to reduce a sliding friction of the A extended rod within the complementarily-shaped channel.

4. The ambidextrous charging handle of claim 3 wherein the low-friction rib is a bead of nylon embedded in a channel formed in the surface of the extended rod.

5. The ambidextrous charging handle of claim 3 wherein the low-friction rib is a bead of polytetrafluoroethylene embedded in a channel formed in the surface of the extended rod.

6. The ambidextrous charging handle of claim 1 wherein the left handle and the right handle comprise grip-enhancing features formed in their respective surfaces.

7. The ambidextrous charging handle of claim 1 wherein the left handle and the right handle are skeletonized.

8. The ambidextrous charging handle of claim 1, formed principally of milled aluminum.

9. The ambidextrous charging handle of claim 8 wherein at least one milled aluminum component is anodized to have a different color surface from at least one other milled aluminum surface.

10. The ambidextrous charging handle of claim 9 wherein the at least one milled aluminum component is milled again after anodizing to expose at least a portion of a base material of the component.

* * * * *